US006637047B1

(12) United States Patent
Zettler

(10) Patent No.: US 6,637,047 B1
(45) Date of Patent: Oct. 28, 2003

(54) WATERFALL-SIMULATED WALL STRUCTURE FOR A SHOWER STALL/TUB

(76) Inventor: Rory P. Zettler, P.O. Box 257, Neustadt, Ontario (CA), N0G 2M0

( * ) Notice: Subject to any disclaimer, the term of this patent is extended or adjusted under 35 U.S.C. 154(b) by 0 days.

(21) Appl. No.: 10/100,406

(22) Filed: Mar. 19, 2002

(51) Int. Cl.[7] ..... A47K 3/16

(52) U.S. Cl. ..... 4/584; 4/591; 4/612; 4/605; 52/35

(58) Field of Search ..... 4/584, 591, 612, 4/605, 559; 52/35

(56) References Cited

U.S. PATENT DOCUMENTS 3,479,778 A * 11/1969 Johnson ..... 52/35
3,557,390 A * 1/1971 Ruggles et al. ..... 4/584
4,109,426 A * 8/1978 Dobija ..... 52/35
4,110,852 A * 9/1978 Kline ..... 4/492
6,425,147 B1 * 7/2002 Hanson ..... 4/584

* cited by examiner

*Primary Examiner*—Gregory L. Huson
*Assistant Examiner*—Azy Kokabi

(57) ABSTRACT

A waterfall-simulated wall structure for a shower stall/tub for providing a unique outdoorsy type of environment for taking showers. The waterfall-simulated wall structure for a shower stall/tub includes a wall assembly including portable walls being adapted to be spaced from stall/tub walls forming a conventional shower stall/tub, and being arranged to allow water to occupy the space between the portable walls and the stall/tub walls, each of said portable walls having a front side which simulates a side of a waterfall, said wall assembly further including rock-simulated members being attached at bases of the portable walls for allowing a user to rest one's feet thereupon when washing.

6 Claims, 1 Drawing Sheet

WATERFALL-SIMULATED WALL STRUCTURE FOR A SHOWER STALL/TUB

BACKGROUND OF THE INVENTION

1. Field of the Invention

The present invention relates to waterfall-simulated wall structures and more particularly pertains to a new waterfall-simulated wall structure for a shower stall/tub for providing a unique outdoorsy type of environment for taking showers.

2. Description of the Prior Art

The use of waterfall-simulated wall structures is known in the prior art. More specifically, waterfall-simulated wall structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,893,179; U.S. Pat. No. 5,309,581; U.S. Pat. No. Des. 257,980; U.S. Pat. No. 5,115,974; U.S. Pat. No. 5,127,111; and U.S. Pat. No. 6,134,722.

While these devices fulfill their respective, particular objectives and requirements, the aforementioned patents do not disclose a new waterfall-simulated wall structure for a shower stall/tub. The prior art describes inventions having stalls and tubs with walls and also having spigots extending through the wall.

SUMMARY OF THE INVENTION

The general purpose of the present invention, which will be described subsequently in greater detail, is to provide a new waterfall-simulated wall structure for a shower stall/tub which has many of the advantages of the waterfall-simulated wall structures mentioned heretofore and many novel features that result in a new waterfall-simulated wall structure for a shower stall/tub which is not anticipated, rendered obvious, suggested, or even implied by any of the prior art waterfall-simulated wall structures, either alone or in any combination thereof. The present invention includes a wall assembly including portable walls being adapted to be spaced from stall/tub walls forming a conventional shower stall/tub, and being arranged to allow water to occupy the space between the portable walls and the stall/tub walls, each of said portable walls having a front side which simulates a side of a waterfall, said wall assembly further including rock-simulated members being attached at bases of the portable walls for allowing a user to rest one's feet thereupon when washing. None of the prior art describes walls in shower stalls/tubs being shaped and formed like that of waterfalls with the water flowing over the top and into the stall/tub.

There has thus been outlined, rather broadly, the more important features of the waterfall-simulated wall structure for a shower stall/tub in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new waterfall-simulated wall structure for a shower stall/tub which has many of the advantages of the waterfall-simulated wall structures mentioned heretofore and many novel features that result in a new waterfall-simulated wall structure for a shower stall/tub which is not anticipated, rendered obvious, suggested, or even implied by any of the prior art waterfall-simulated wall structures, either alone or in any combination thereof.

Still another object of the present invention is to provide a new waterfall-simulated wall structure for a shower stall/tub for providing a unique outdoorsy type of environment for taking showers.

Still yet another object of the present invention is to provide a new waterfall-simulated wall structure for a shower stall/tub that would be easy and convenient to install in one's shower stall/tub.

Even still another object of the present invention is to provide a new waterfall-simulated wall structure for a shower stall/tub that would invigorate and provide uplift to a user who may otherwise be in a depressed state of mind.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
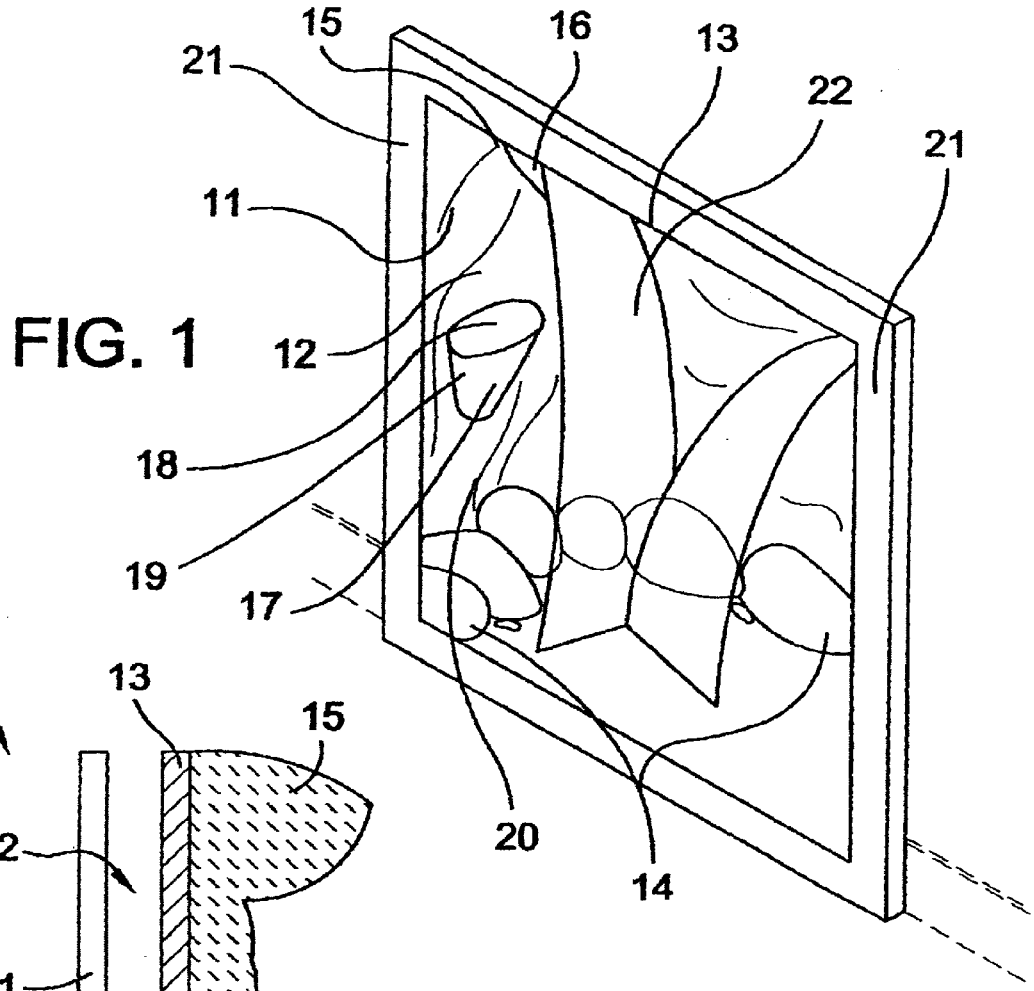
FIG. 1 is a perspective view of a new waterfall-simulated wall structure for a shower stall/tub according to the present invention and shown in use.
Figure 2:
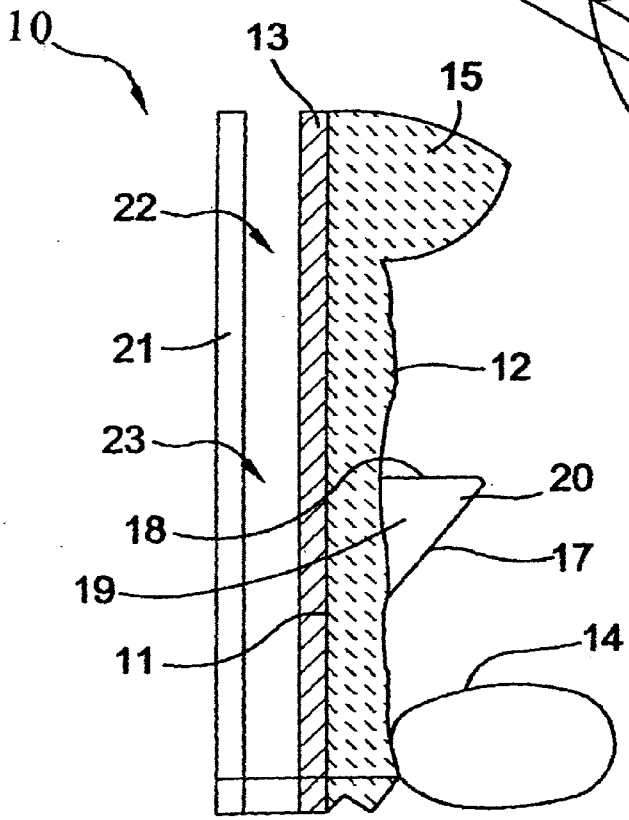
FIG. 2 is a side elevational view of the present invention.

With reference now to the drawings, and in particular to FIGS. 1 through 2 thereof, a new waterfall-simulated wall structure for a shower stall/tub embodying the principles and concepts of the present invention and generally designated by the reference numeral 10 will be described.

As best illustrated in FIGS. 1 through 2, the waterfall-simulated wall structure for a shower stall/tub 10 generally comprises a wall assembly including portable walls 11 being adapted to be spaced from stall/tub walls 21 forming a conventional shower stall/tub, and being arranged to allow water 22 to occupy the space 23 between the portable walls 11 and the stall/tub walls 21. Each of the portable walls 11 has a front side 12 which simulates a side of a waterfall having a crag and undulating surface. The wall assembly further includes rock-simulated members 14 being conventionally attached at bases of the portable walls 11 for allowing a user to rest one's feet thereupon when washing. Each of the portable walls 11 has a top edge 13 over which the water 22 is allowed to flow. The wall assembly further includes rock-simulated ledges. 15 being conventionally and integrally attached and molded to the front sides 12 of the portable walls 11 near the top edges 13 thereof and being adapted to create waterfalls; wherein the water 22 flows therefrom and into the shower stall/tub away from the portable walls 11 to allow the user to stand beneath the waterfalls. Each of the rock-simulated ledges 15 protrudes outwardly of a respective portable wall 11 and has a top side. Each of the rock-simulated ledges 15 has a trough 16 being conventionally disposed in the top side thereof and upon which the water 22 flows to form the waterfalls. The wall assembly further includes a rock-simulated shelf 17 being conventionally attached to the front side 12 of one of the portable walls 11 and being disposed intermediate of the top edge 13 and the base. The rock-simulated shelf 17 has a top 18, and sides 19, and also a front 20 which slants downwardly and toward the front side 12 of the portable wall 11.

In use, the user turns on the water which fills the space between the stall/tub wall 21 and the portable wall 11 and which begins to flow over the top edge 13 of the portable wall 11 and flow upon the trough 16 and from the rock-simulated ledge 15 into the stall/tub like that of a waterfalls with the user standing beneath the waterfalls to wash and cleanse oneself like that in a shower stall. The user props one's feet upon the rock-simulated members 14 to conveniently wash one's feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the waterfall-simulated wall structure for a shower stall/tub. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A waterfall-simulated wall structure for a shower stall/tub comprising:

a wall assembly including portable walls being spaced from stall/tub walls forming a conventional shower stall/tub, and being arranged to allow water to occupy the space between said portable walls and the stall/tub walls each of said portable walls having a front side which simulates a side of a waterfall having a crag and undulating surface, said wall assembly further including rock-simulated members being attached at bases of said portable walls for allowing a user to rest one's feet thereupon when washing.

2. A waterfall-simulated wall structure for a shower stall/tub as described in claim 1, wherein said wall assembly further includes rock-simulated ledges being attached to said front sides of said portable walls near said top edges thereof and being adapted to create waterfalls; wherein the water flows therefrom and into the shower stall/tub away from said portable walls to allow the user to stand beneath the waterfalls.

3. A water-simulated wall structure for a shower stall/tub as described in claim 2, wherein each of said rock-simulated ledges protrudes outwardly of a respective said portable wall and has a top side.

4. A water-simulated wall structure for a shower stall/tub as described in claim 3, wherein each of said rock-simulated ledges has a trough disposed in said top side thereof and upon which the water flows to form the waterfalls.

5. A waterfall-simulated wall structure for a shower stall/tub as described in claim 4, wherein said wall assembly further includes at least one rock-simulated shelf being attached to said front side of one of said portable walls and being disposed intermediate of said top edge and said base.

6. A waterfall-simulated wall structure for a shower stall/tub as described in claim 5, wherein said at least one rock-simulated shelf has a top, and sides, and also a front which slants downwardly and toward said front side of said portable wall.

* * * * *